US005414430A

United States Patent [19]

Hansén

[11] Patent Number: 5,414,430

[45] Date of Patent: * May 9, 1995

[54] DETERMINATION OF ROLL ANGLE

[75] Inventor: Ake Hansén, Karlstad, Sweden

[73] Assignee: Bofors AB, Karlskoga, Sweden

[ * ] Notice: The portion of the term of this patent subsequent to Nov. 17, 2009 has been disclaimed.

[21] Appl. No.: 117,649

[22] Filed: Sep. 8, 1993

Related U.S. Application Data

[63] Continuation of Ser. No. 907,578, Jul. 2, 1992, abandoned.

[30] Foreign Application Priority Data

Jul. 2, 1991 [SE] Sweden ..... 9102056

[51] Int. Cl.[6] ..... F41G 7/30

[52] U.S. Cl. ..... 342/188; 244/3.14; 244/3.21; 244/3.11

[58] Field of Search ..... 342/188; 244/3.21, 3.11, 244/3.14, 3.13

[56] References Cited

U.S. PATENT DOCUMENTS

| | | | |
|---|---|---|---|
| 3,633,212 | 10/1970 | Cooper | 356/369 X |
| 3,656,161 | 4/1972 | MacPherson | 342/365 |
| 3,662,384 | 5/1972 | Albert | 342/58 |
| 3,897,918 | 8/1975 | Gulick, Jr. et al. | 244/3.19 |
| 4,047,678 | 9/1977 | Miller, Jr. et al. | 244/3.16 |
| 4,072,281 | 2/1978 | Miller, Jr. et al. | 244/3.16 |
| 4,097,007 | 6/1978 | Fagan et al. | 244/3.11 |
| 4,347,996 | 9/1982 | Grosso | 244/3.16 |
| 4,422,601 | 12/1983 | Chavany et al. | 244/3.13 |
| 4,613,863 | 9/1986 | Mitchell | 434/2 X |
| 4,614,317 | 9/1986 | Stavis | 244/3.19 |
| 4,641,801 | 2/1987 | Lynch, Jr. et al. | 244/3.14 |
| 4,750,689 | 6/1988 | Yff | 244/3.14 |
| 4,928,906 | 5/1990 | Sturm | 244/3.22 |
| 4,979,696 | 12/1990 | Yff | 244/3.14 |
| 5,018,684 | 5/1991 | Allgaier et al. | 244/3.13 |
| 5,039,029 | 8/1991 | Taylor et al. | 244/3.11 |
| 5,099,246 | 3/1992 | Skagerlund | 342/361 |
| 5,137,360 | 8/1992 | Ferrar | 356/350 |
| 5,163,637 | 11/1992 | Hansen | 244/3.21 |
| 5,233,901 | 8/1993 | Nilsson et al. | 89/6.5 |
| 5,259,567 | 11/1993 | Jano et al. | 244/3.11 |

FOREIGN PATENT DOCUMENTS

| | | |
|---|---|---|
| 0239156 | 9/1987 | European Pat. Off. . |
| 0341772 | 1/1989 | European Pat. Off. . |
| 0343131 | 4/1989 | European Pat. Off. . |
| 3529277 | 3/1987 | Germany . |
| 90013707 | 2/1991 | Sweden . |
| 8303894 | 11/1983 | WIPO . |

OTHER PUBLICATIONS

Aruga, T., Ueda, K. et al, "Determination of a Spacecraft Attitude Using a Ground-based Radar", 2219 Applied Optics, vol. 21, (1982) Jun., No. 12, pp.2291–2295.

*Primary Examiner*—John B. Sotomayor

*Attorney, Agent, or Firm*—Pollock, Vande Sande & Priddy

[57] ABSTRACT

A system for an unambiguous determining of the roll angle attitude of a rotating projectile, grenade, missile or the like with the aid of a polarized electromagnetic radiation, comprises a transmitter for emitting a position-determining polarized radiation (space wave) in the direction of the projectile and a receiver arranged in the projectile for receiving the emitted radiation. The emitted space wave is made up of a carrier wave reference with frequency $f_1$ which has been phase-modulated with a modulation frequency $f_2$, wherein $f_2$ is $<<f_1$ and wherein $f_2$ forms a submultiple of the carrier wave frequency $f_1$.

11 Claims, 3 Drawing Sheets

Fig. 1
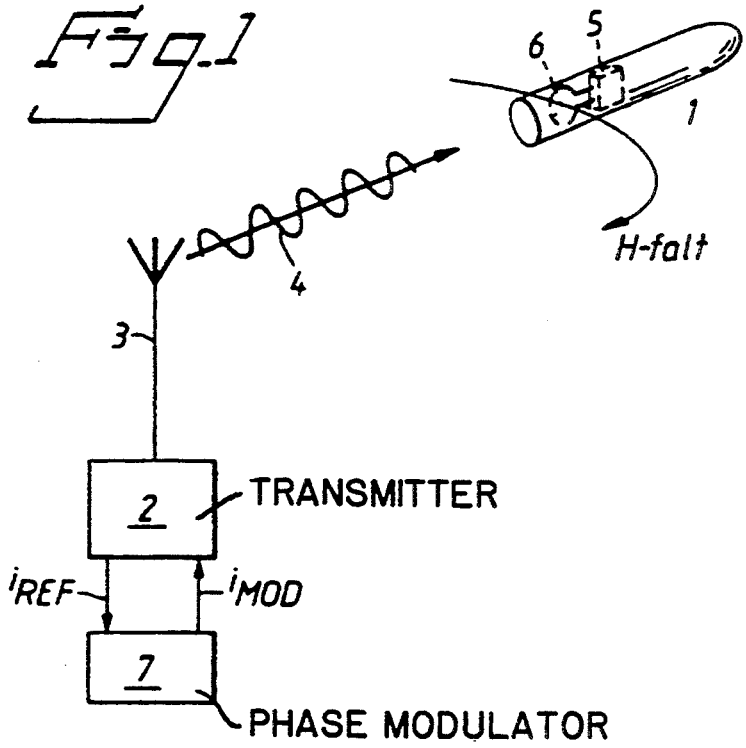
Fig. 2a
Fig. 2b
Fig. 2c
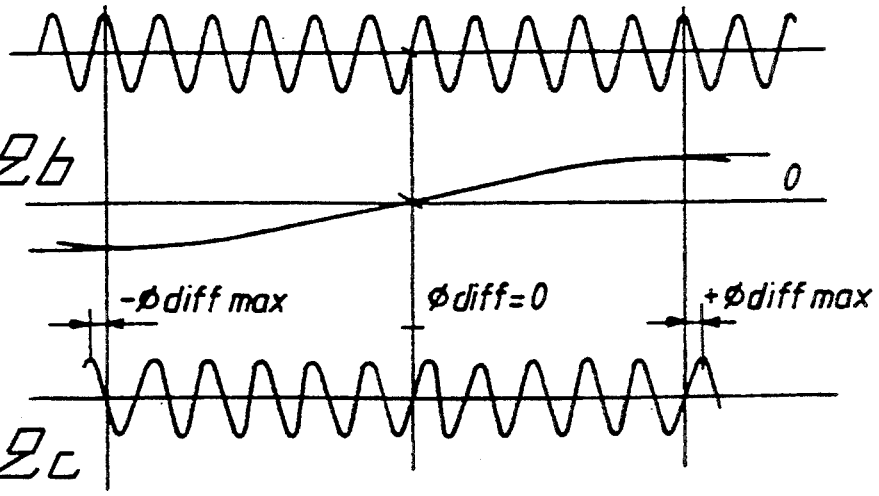

DETERMINATION OF ROLL ANGLE

This application is a continuation of Ser. No. 07/907,578, filed on Jul. 2, 1992, now abandoned.

FIELD OF THE INVENTION

The present invention relates to an arrangement for determining the roll attitude of a rotating projectile, grenade, missile or the like with the aid of polarized electromagnetic radiation.

BACKGROUND OF THE INVENTION

The present invention is applicable to all types of projectiles, missiles or the like which are shot out of a firing tube or launching tube and which rotate in their track. In particular, this invention can be used with so-called end-phase-controlled ammunition, that is projectiles which are fired in the conventional manner in a ballistic track to the immediate vicinity of the target where they receive a command for required correction. Due to the fact that the projectile is rotating in its track, its roll attitude must be determined when the command is executed. In the absence of roll attitude determining elements, an error is otherwise produced when the course correction is carried out.

It is already known from Swedish Patent 8801831-2 to determine the roll angle attitude with the aid of polarized electromagnetic radiation comprising a transmitter arranged to emit a polarized radiation in the direction of the projectile and a polarization-sensitive receiver arranged in the projectile. By allowing the emitted polarized radiation to comprise at least two mutually phase-locked radiation components with wavelength relations of 2:1 and/or multiples thereof and which are superimposed and form an asymmetric curve shape, the roll attitude of the projectile can be unambiguously determined.

The abovementioned arrangement presupposes that a transmitter is placed in connection with the launching place of the projectile and that the projectile is provided with a receiver antenna directed towards the back for receiving the emitted radiation.

The arrangement furthermore presupposes that two mutually phase-locked radiation components with different frequencies are sent out. This entails that both transmitter and receiver become relatively complicated in their construction.

It is also known from EP 0 341 772 to determine the roll angle attitude by providing the single carrier wave with a sinusoidal amplitude modulation for continuously transmitting information about the phase angle. Such a system has advantages through a simpler construction of the receiver section in the projectile. But it is also disclosed that it requires two antennas in the receiver with known mutual orientation.

From Swedish Patent Application 9001370-7, it is also already known to determine the roll angle attitude with the aid of partly a polarized sinusoidal radiation within the longwave band and partly a microwave radiation in the form of a pulse train where the pulses indicate that the long wave component is located at a certain phase angle, for example, the sinusoidal signal zero transition with positive derivative. The two radiation components are then detected in the grenade and supplied to a microprocessor system for evaluation.

The advantage of transferring the message about the phase angle only at certain times is that such a system becomes more interference-proof. The risk of detection becomes less, it is more difficult to calculate the frequency utilized for transmission from the short pulses and in this way to interfere with the transmission.

In such a system, one therefore depends on two radiation components, both a longwave component and a microwave component. A synchronization between transmitter and receiver is also necessary.

SUMMARY OF THE INVENTION

It is the aim of this invention to produce an alternative to the arrangements described above for roll angle determination, where instead a polarized carrier wave is phase-modulated with a significantly lower frequency which forms a submultiple of the carrier wave frequency. In the receiver, the phase of the received radiation is decoded and compared with the carrier wave reference for calculating the current roll angle attitude.

The advantage of utilizing a phase-modulated carrier wave according to the present invention is that the receiver section in the projectile/grenade can be made completely autonomous, without requirement for synchronization with the transmitter. The transmitter is preferably operating within the longwave band (30–300 kHz), the carrier wave frequency must exceed 100 Hz, for example it can be 300 kHz and the modulation frequency can be 3 kHz.

BRIEF DESCRIPTION OF THE PREFERRED EMBODIMENT

An embodiment of the invention is shown diagrammatically in the attached drawings, in which:

FIG. 1 is a view of the projectile and a ground-based transmitter;

FIGS. 2*a–c* show the curve shape of the radiation transmitted according to the present invention;

FIG. 3 shows a block diagram of the transmitter;

FIG. 4*a* and 4*b* show the envelope shaper and phase shifter used in the transmitter;

FIG. 5 shows a block diagram of the receiver; and

FIGS. 6*a–6d* show the behavior of the signal on demodulation in the receiver.

DETAILED DESCRIPTION OF THE PRESENT INVENTION

Figure 3:
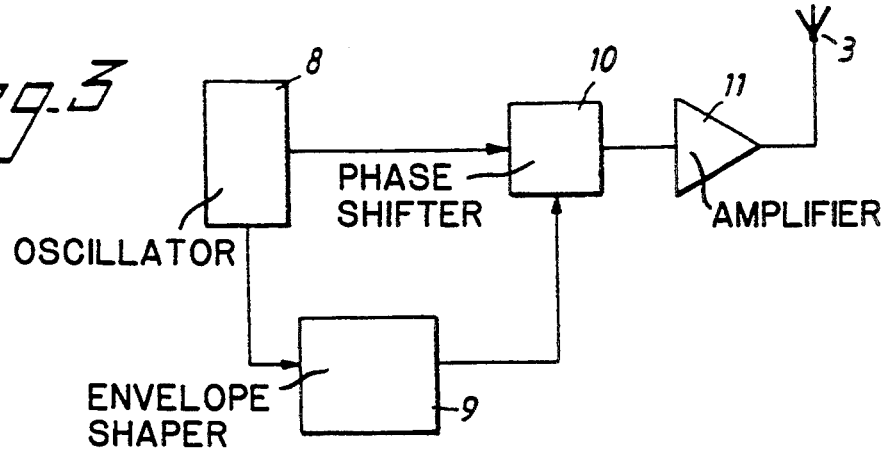

FIG. 1 shows a projectile, grenade, missile or the like 1 which is rotating in its track on the way towards a target. For different reasons it is required to determine the roll attitude angle of the projectile. On the launching arrangement, for example a canon, or in its immediate vicinity, a transmitter 2 is placed, for example, a longwave transmitter which sends out a linearly polarized space wave 4 via an antenna 3 towards the projectile 1. The projectile is provided with a receiver 5 having an antenna 6 and evaluating element (electronics) for determining the roll angle attitude.

In the transmitter, a carrier wave reference $i_{REF}$ with a frequency $f_1$ is generated, see FIG. 2*a*. A modulation signal, $i_{MOD}$, FIG. 2*b*, the frequency of which is $f_2 << f_1$ and where $f_2$ is a multiple or submultiple of the carrier wave frequency $f_1$, is supplied through a phase modulator 7. For example, the carrier wave frequency $f_1$ can go up to 300 kHz and the modulation frequency to 3 kHz. FIG. 2*c* shows the phase-modulated space wave 4.

The transmitter comprises an HF oscillator of the stable type 8 for generating the nominal carrier wave frequency, an envelope shaper 9 and a phase shifter 10, see FIG. 3. The output of the phase shifter is connected to the transmitter antenna 3 via an amplifier 11.

Figure 4A:
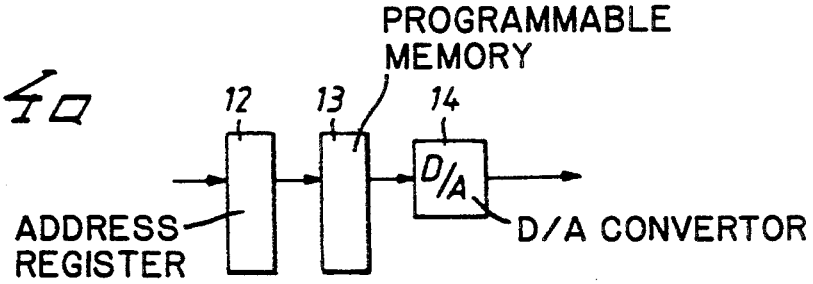
Figure 4B:
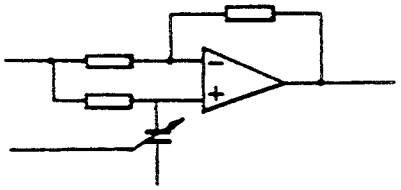
Figure 5:
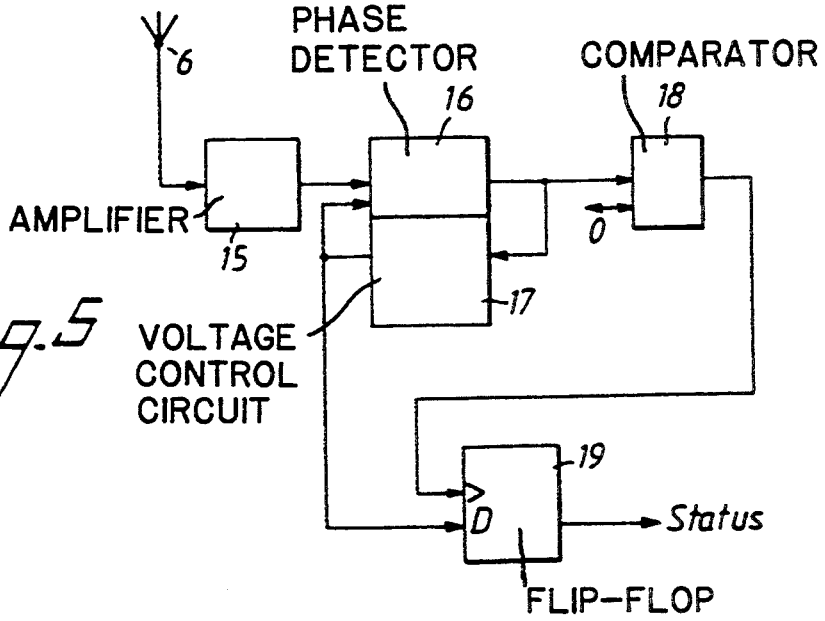
Figure 6A:
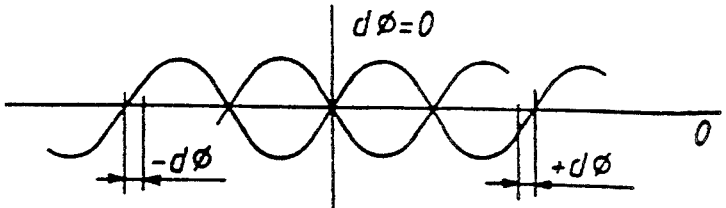
Figure 6B:
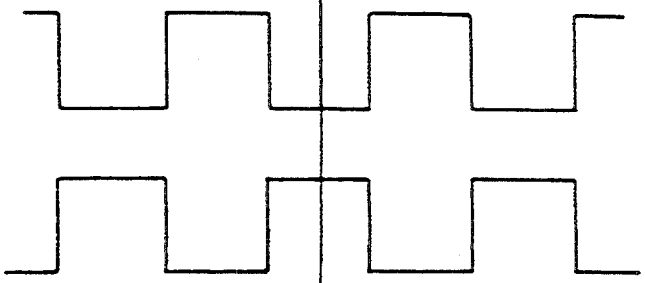
Figure 6C:
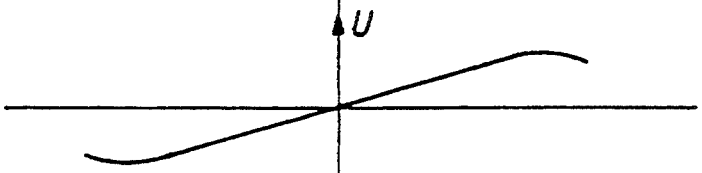
Figure 6D:
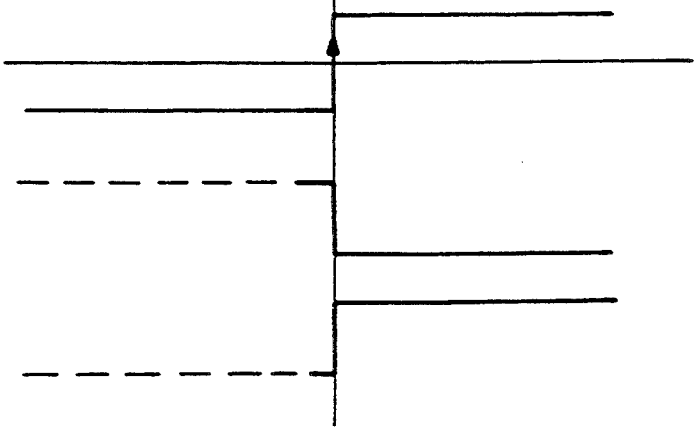

The envelope shaper is made up of an address register 12, a programmable memory (PROM) 13 and a digital-/analog converter 14 and the phase shifter 10 can be an active phase shift filter of a known type, see FIG. 4*b*, with two inputs, on the one hand for the carrier wave reference and on the other hand for the control signal from the envelope shaper 9.

The receiver comprises an amplifier 15, a phase detector 16 with a so-called VCO circuit 17 (voltage control oscillator) for detecting the phase shift. The phase detector output is connected to a comparator 18 and the comparator output signal is used for clocking a memory circuit (D-type flip flop) 19, the output of which stores a status level from the phase angle of the VCO circuit (UP/DOWN information).

The arrangement operates in the following manner. The nominal carrier wave frequency is generated in the transmitter by the HF oscillator 8, for example an oscillator with crystal element. A carrier wave reference of digital appearance is supplied to the envelope shaper 9 in which an address register 12 is clocked with the carrier wave reference. The address register fetches weighted digital values for a sinusoidal envelope from the programmable memory (PROM) 13. The digital-/analog converter 14 converts the digital values to an analog signal. The analog signal is supplied to the output as control signal which is used for phase-shifting the original carrier wave in the phase shifter 10 which is constructed of an active phase-shift filter, see FIG. 4*b*, with two inputs. After that, the modulated signal is amplified before it is supplied to the antenna 3.

The space wave thus phase-modulated is received by the antenna 6 in the projectile. The antenna signal is supplied after amplification to a so-called phase-locked loop in the phase detector 16 in the receiver. The phase-locked loop detects the phase shift of the received signal with the aid of a frequency which is generated by the VCO circuit 17. If the phase difference deviates from 90°, the phase detector generates a signal which deviates from zero. This error signal is used as control signal for the VCO circuit for regulating the frequency of the latter. The oscillator will follow the phase of the incoming signal and the control voltage from the phase detector is an image of the phase modulation signal. The reference signal thus detected is supplied to the comparator 18 which has a threshold level which corresponds to the zero transition of the modulator signal at the transmitter end. The comparator output signal is used for clocking the memory circuit in the form of a D-type flip flop 19, the output of which stores a status level from the phase angle of the VCO circuit (UP/DOWN information).

The signal behavior on demodulation in the receiver can be seen in FIG. 6. The appearance of the antenna signal with the antenna pointing upward or downward is shown in FIG. 6*a*. The VCO signals for the antenna pointing upward or the antenna pointing downward, respectively, are seen in FIG. 6*b*. It also shows that the control voltage from the phase detector, see FIG. 6*c*, is an image of the phase modulation signal, see FIG. 2*b*. The comparator output signal or the memory circuit output signal (status level) with the antenna pointing upward or the antenna pointing downward, respectively, is shown in FIG. 6*d*. Using this up/down information, the current roll angle attitude can then be calculated in a conventional manner.

I claim:

1. A system for an unambiguous determining of the roll angle attitude of a rotating projectile, grenade, missile or the like with the aid of a linearly polarized electromagnetic radiation, said system comprising a transmitter for emitting a position-determining linearly polarized radiation (space wave) in the direction of the projectile and a receiver arranged in the projectile for receiving the emitted radiation and determining said roll angle attitude from said received space wave, the emitted space wave is formed from a continuous carrier wave reference with frequency $f_1$: which has been phase-modulated by modulating said carrier wave reference with an essentially sinusoidal modulation frequency $f_2$, prior to being emitted by said transmitter and wherein $f_2$ is $<<f_1$ and wherein $f_2$ forms a submultiple of the carrier wave frequency $f_1$.

2. A system according to claim 1, wherein the transmitter operates within the longwave band.

3. A system according to claim 1, wherein the transmitter comprises an HF oscillator for generating the nominal carrier wave reference, an envelope shaper, the output of which is connected to a phase shifter, the output of which, in turn, is connected to the transmitter antenna.

4. A system according to claim 3, wherein the envelope shaper comprises an address register, a programmable memory (PROM) and a digital/analog converter.

5. A system according to claim 1, wherein the receiver comprises a phase detector for detecting the phase shift of the received signal.

6. A system according to claim 5, wherein the phase detector output is connected to a comparator, the comparator output signal being used for clocking a memory circuit (D-type flip flop), the output of which stores a status level relating to the phase angle (UP/DOWN information).

7. A system for an unambiguous determining of the roll angle attitude of a rotating projectile or the like comprising a transmitter for emitting a position-determining polarized radiation (space wave) in the direction of the projectile and a receiver located in the projectile for receiving said emitted space wave, said transmitter including:

means for generating a continuous carrier wave reference $i_{ref}$ with a frequency $f_1$;

means for supplying a substantially sinusoidal modulation signal with a frequency $f_2$ wherein $f_2<<f_1$ and a submultiple of $f_1$;

means for modulating said carrier wave $ref_{iref}$ with said modulation signal and for transmitting a resulting phase-modulated carrier space wave from said transmitter to said receiver; and said receiver including means for determining said roll angle attitude based on said received phase-modulated carrier wave.

8. A system according to claim 7, wherein said means for determining includes means for decoding the phase of the received carrier wave and comparing with the carrier wave reference for calculating said roll angle attitude.

9. A system according to claim 1, wherein the transmitter operates within the longwave band and wherein the transmitter comprises an HF oscillator for generating the nominal carrier wave reference, an envelope shaper, the output of which is connected to a phase shifter, the output of which, in turn, is connected to the transmitter antenna.

10. A system according to claim 9, wherein the envelope shaper comprises an address register, a programmable memory (PROM) and a digital/analog converter.

11. A system according to claim 1, wherein the receiver comprises a phase detector for detecting the phase shift of the received signal and wherein the phase detector output is connected to a comparator, the comparator output signal being used for clocking a memory circuit (D-type flip flop), the output of which stores a status level relating to the phase angle (UP/DOWN information).

* * * * *